United States Patent [19]

Abraham et al.

[11] Patent Number: 5,007,360

[45] Date of Patent: Apr. 16, 1991

[54] MAST

[76] Inventors: Joseph Abraham, 235 A Darby St., Newcastle, NSW, Australia, 2300; Michael Hamonet, 3 Warhurst Street, Toronto, NSW; Phillip Gracie, Rofe Street, Coal Point, NSW, both of Australia, 2283; Warwick J. Hood, 10 Ford Street, Balmain, NSW, Australia, 2041

[21] Appl. No.: 441,201

[22] Filed: Nov. 22, 1989

Related U.S. Application Data

[63] Continuation of Ser. No. 165,195, filed as PCT AU87/00088 on Apr. 2, 1987, published as WO87/05962 on Oct. 8, 1987.

[30] Foreign Application Priority Data

Apr. 2, 1986 [AU] Australia ..... 05295

[51] Int. Cl.[5] ..... B63B 15/00

[52] U.S. Cl. ..... 114/90

[58] Field of Search ..... 52/730, 731, 720, 648, 52/121; 114/89, 90; 212/266

[56] References Cited

U.S. PATENT DOCUMENTS

| | | | |
|---|---|---|---|
| 449,375 | 3/1981 | Meyer et al. | 52/648 |
| 1,574,563 | 2/1926 | Duff | 52/720 |
| 2,454,640 | 11/1948 | Eichner | 114/90 |
| 2,519,230 | 8/1950 | Crankshaw | 114/90 |
| 3,571,991 | 3/1971 | Doocy et al. | 52/731 |
| 3,572,528 | 3/1971 | Morton et al. | 52/731 |
| 4,480,570 | 11/1984 | Rosenfield et al. | 114/90 X |

FOREIGN PATENT DOCUMENTS

| | | | |
|---|---|---|---|
| 613236 | 11/1926 | France . | |
| 782133 | 5/1935 | France . | |
| 625746 | 7/1949 | United Kingdom | 114/90 |

*Primary Examiner*—David A. Scherbel
*Assistant Examiner*—Lan Mai
*Attorney, Agent, or Firm*—Townsend and Townsend

[57] ABSTRACT

A pole structure comprising two elongated sheet metal or extruded sections (1 and 2) which are joined together by spacers (7) to provide a gap (5) between the adjacent edges of the elongated sections (1 and 2). This structure provides access to the interior and is most suitable for utilization as a mast of a sailing yacht, being lighter in weight than the standard masts yet being as structurally stable and flexible.

17 Claims, 3 Drawing Sheets

MAST

This application is a continuation of an application Ser. No. 07/165195 filed as PCT AU87/00088 on Apr. 2, 1987, published as WO87/05962 on Oct. 8, 1987, now abandoned.

The present invention relates to an improved construction of a metal pole, and in particular, to an improved tubular metal mast for use in sailing yachts.

The usual method of manufacture of metal (typically aluminium alloy) masts for use in sailing yachts is by the extrusion, through a die, of an oval or elliptical cross-section tube. For masts which require a larger cross-section than may be extruded in one piece through the size die that is available in the largest extrusion presses, it is usual for the mast to be built up from two extruded pieces which are connected by welding or other means in the longitudinal direction.

For masts that require a longer length than may be extruded in one piece, it is usual for the masts to be built up from two extruded pieces which are connected by welding or other means in the transverse direction.

It is usually desirable for masts to be tapered. That is to say that they have a smaller cross-section at the top than the maximum extruded cross-section for the particular die. In the normal method of construction this taper is obtained by cutting long, wedge shaped pieces out of the side walls of the mast, and closing the wedge shaped gaps by welding the edges together.

Masts made by the extrusion process are normally of an aluminium alloy which is heat treated after extrusion so as to develop fully its desirable strength factors. Subsequent welding reduces substantially the strength factors over an area extending from the centre of the weld to points out beyond each side of the weld. This area is known as the "heat affected zone" and its extent varies depending on welding techniques, heat input and type and thickness of parent material.

In masts constructed from this normal method, the cross-section is a tube. Access to the interior of these masts for the attachment and servicing of the essential rigging fittings is only possible from each end. This situation is neither convenient nor entirely satisfactory. As a result, normally constructed masts are usually provided with fittings which are attached to the mast by a number of "blind" riveting processes and/or by bolts from one side of the mast to the other. Welding is not normally used for the previously mentioned reason of reducing the strength of the mast. Further, once these fittings are attached it is usually not desirable to re-position them, because the drilling of more attachment holes further weakens the structural integrity of the mast.

The present invention seeks to ameliorate these disadvantages by providing a hollow metal pole comprising two longitudinal members which are joined to each other by spacers to provide a gap between the two members.

Each member can be a one piece construction or made up of several sections of varying cross-section.

The invention will now be described with reference to the accompanying drawings, in which.

Preferably the mast members are formed from flat strips of metal by a continuous metal forming process known as "roll forming". If the arrangement of the rollers during the passage of the entire length of the strip through the metal forming machine remains unchanged, a section will be obtained which has no taper.

If, however, the arrangement of the rollers is continuously adjusted, either manually or by a pre-arranged automatic system, a tapered section will be produced. A mast may then be constructed from these sections which has any desired amount of taper from the maximum section. This taper may extend from any point to the top and/or bottom of the mast, as shown in FIG. 1.

Furthermore, the metal strip for fabrication by the roll forming process is normally supplied in a coil, which is much more readily and economically stored and transported than the usual extruded mast sections. Also the metal strip, being a material produced in a rolling mill and not by extrusion and heat treatment, is less expensive to purchase. The aluminium alloy preferred for use in the invention is one having as a major alloying element magnesium. This type of alloy develops its desirable strength characteristics and properties by work hardening, i.e. the process of rolling, pressing or bending it improves its strength. Heat treatment is not necessary. This type of alloy is also readily welded with its strength characteristics very little degraded by this particular joining process. The connection of the various parts of the mast to each other, and of fittings to the mast by welding is therefore possible, without diminishing the strength characteristics and thus performance parameters of the material and, therefore, the mast.

Figure 1:
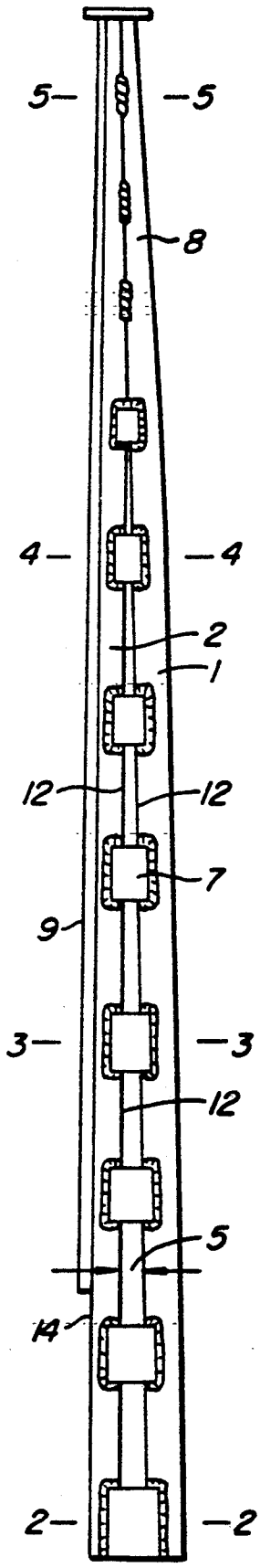
FIG. 1 illustrates a mast section according to an embodiment of the present invention.
Figure 5:
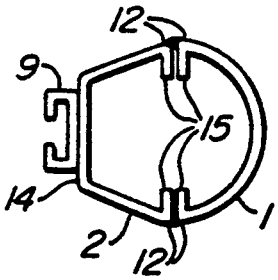
FIG. 5 is a cross section of the mast shown in FIG. 1, along the section line 5—5.
Figure 2:
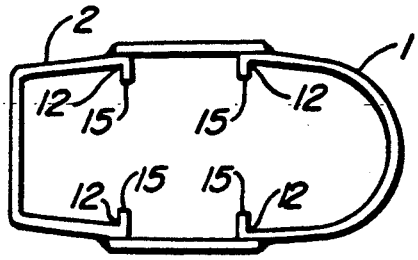
FIG. 2 is a cross section of the mast shown in FIG. 1, along the section line 2—2.

As shown in FIG. 1 one embodiment of the present invention comprises a leading edge mast member 1 which is connected to the trailing edge member 2 by spacers 7 which are welded across the two members. The two members 1 and 2 are in this case of different profiles extruded to the desired lengths. Each member could be of a single profile or as in the two top sections shown in FIG. 2 produced by welding together similar profiles of small dimensions to obtain a pronounced taper.

However preferably the taper of the mast is obtained by having the top section 8 of the mast formed by welding the edges 12 of the mast members 1 and 2 together In general the taper of the mast is formed by having an increasing gaps between the edges 12 of the leading mast member 1 and the trailing mast member 2 down the length of the mast, as shown in FIG. 1, whereby different width spacers 7 are welded between the two mast members 1 and 2.

At the trailing edge 14 of the member 2, a track 9 can be welded or bolted into position to support by means of a slide the luff rope of the mainsail (not shown).

Where the mast is under localized stress such as in the area of the spreaders and the attachment of the boom (not shown) the spacers 7 can be moved closer together to strengthen the sections of the mast.

Figure 6:
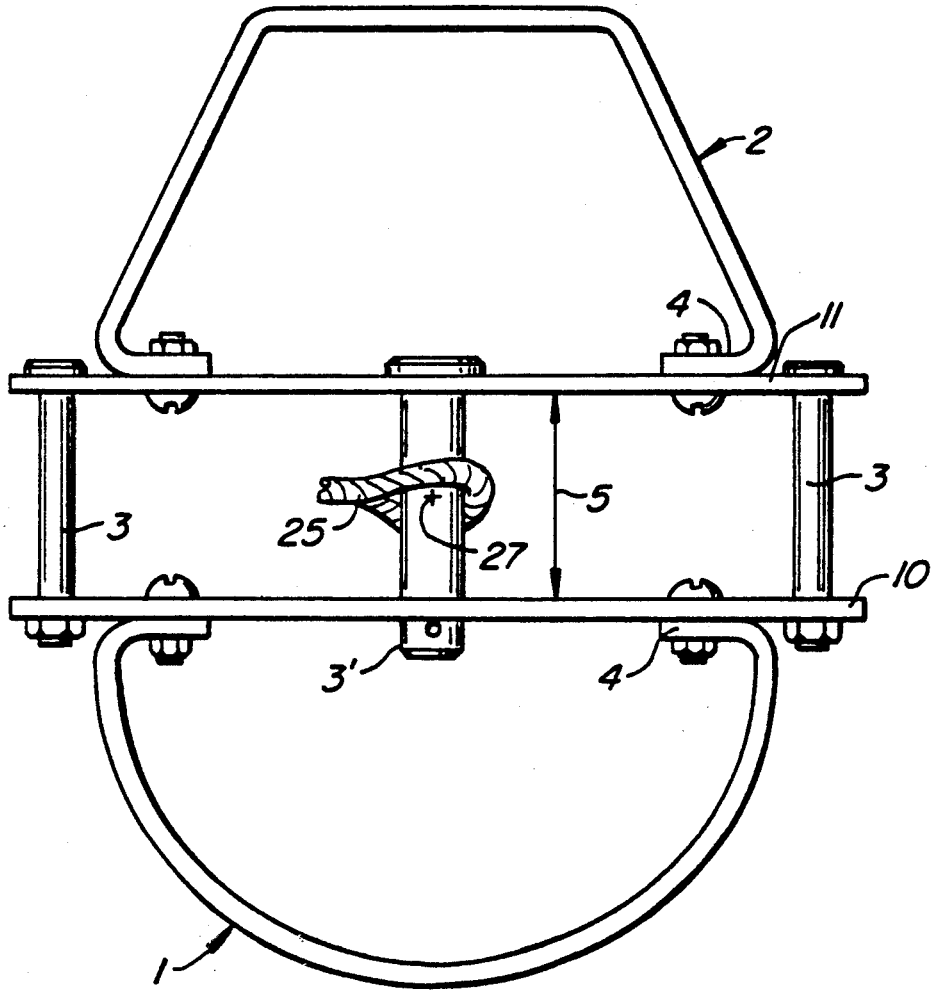
FIG. 6 shows a section through a mast according to a second embodiment of the present invention showing one of the spacers connecting the two mast members together.
Figure 8:
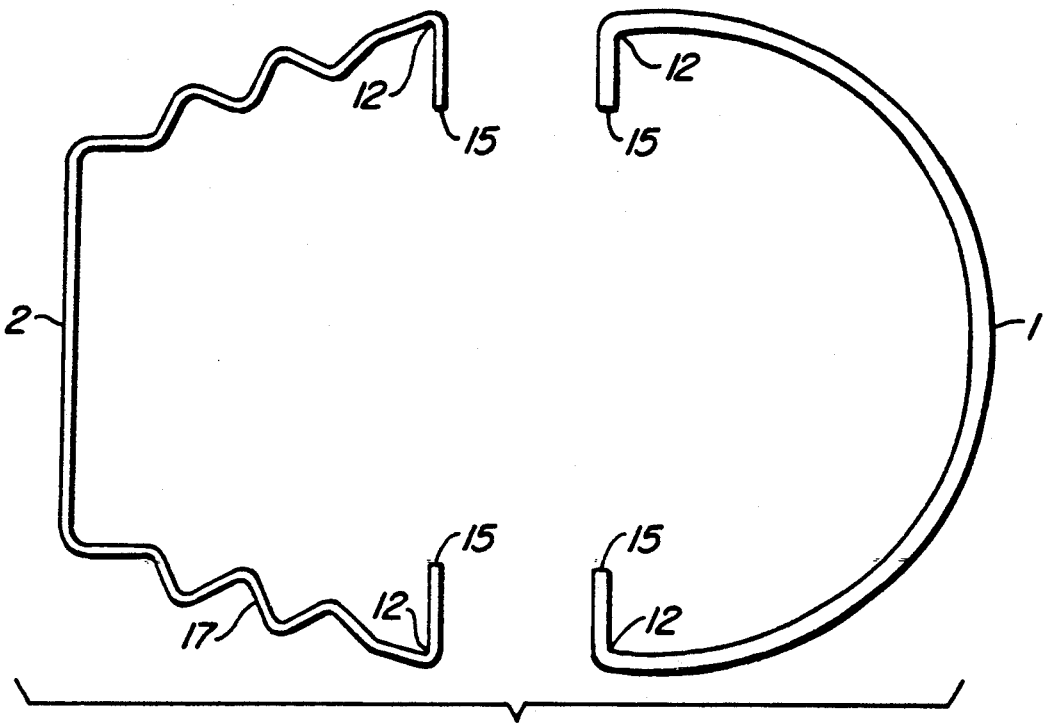
FIGS. 7 and 8 are exploded cross section views of alternative mast section configurations.

A further embodiment of a mast produced in accordance with an embodiment of the present invention is shown in FIG. 6 wherein the leading edge member 1 is bolted to a brace 10 and the trailing edge mast member 2 is bolted to a similar brace 11. These braces 10 and 11 are held apart by means of fittings 3. Preferably the braces 10 and 11 are bolted to the re-entrant flanges 4.

A longitudinal gap 5 is formed in each side wall of the mast, as shown in FIG. 1, which allows ready access to the interior of the mast at any point. Ropes necessary for the hoisting and lowering of sails, and electrical wiring for navigational equipment and instruments, are usually led internally on yacht masts. This invention, allowing as it does easy access to the interior of the mast for installation, inspection and repair of these wires and ropes, greatly improves this area of mast construction and rigging.

In addition to the abovementioned fittings which not only connect the various longitudinal pieces of the mast itself, but also provide anchorage points for rigging wires 25 used to hoist and control the sails, small metal clips are bolted to the longitudinal lips at the necessary spacing to maintain the various longitudinal pieces, which comprise the body of the mast in the correct location with respect to each other. As shown in FIG. 6, a central fitting 3' is located on the central or neutral axis 27 of the mast so that loads applied by the rigging wires 25 secured to the centrally-located fitting 3' are applied at neutral axis 27. Note that fitting 3' has a larger diameter than fitting 3.

Furthermore, the variation of the length and the position of the clips allows even further control of the amount and position of fore and aft taper.

On the completion of the assembly of the mast, the continuous gaps 5 arranged longitudinally in the mast may be covered with a thin self-adhesive aluminium or plastic, which can be readily removed for access to the interior of the mast. These can, of course, be subsequently replaced. Alternatively a "snap-in" extruded plastic strip may be used.

The back of the mast, that is to say the edge of the mast against which the leading edge of the mainsail is attached, is provided with a groove to support directly the luff rope of the mainsail. The invention also allows for the provision of a track or groove on the forward side of the mast for the purpose of attaching a spar, known as the spinnaker boom, to the mast and allowing the mast end of the spar to be positioned at any desired height. This track or groove on the forward side may extend over any length of the mast.

Figure 3:
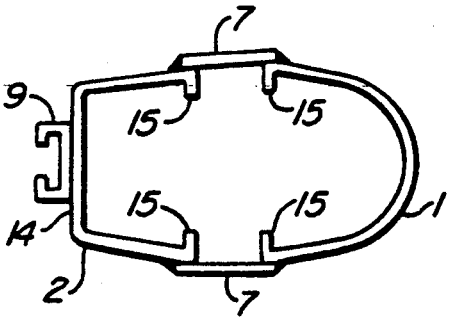
FIG. 3 is a cross section of the mast shown in FIG. 1, along the section line 3—3.

The invention relates also to the possibility of making masts with varying wall thicknesses over any fore and aft cross-section. For example, in a mast comprising two longitudinal pieces, that is a leading edge section 1 and a trailing edge section 2, the requirement of aerodynamic drag reduction makes it desirable that the said leading edge 1 should have a smooth surface, and that in most cases its shape is that of a circular arc or part of an ellipse. The trailing edge 2, however, being located in the turbulent and usually separated air flow "downstream" from the leading edge may be made to any shape to suit the strength needs of the mast. For example the stiffness (i.e. strength as a column) of the mast may be increased, while its weight is reduced by forming the trailing edge part 2 of the mast from metal which is thinner than that section during the roll forming process, as shown in FIG. 3.

Figure 4:
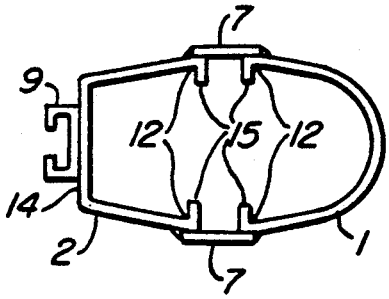
FIG. 4 is a cross section of the mast shown in FIG. 1, along the section line 4—4.
Figure 7:
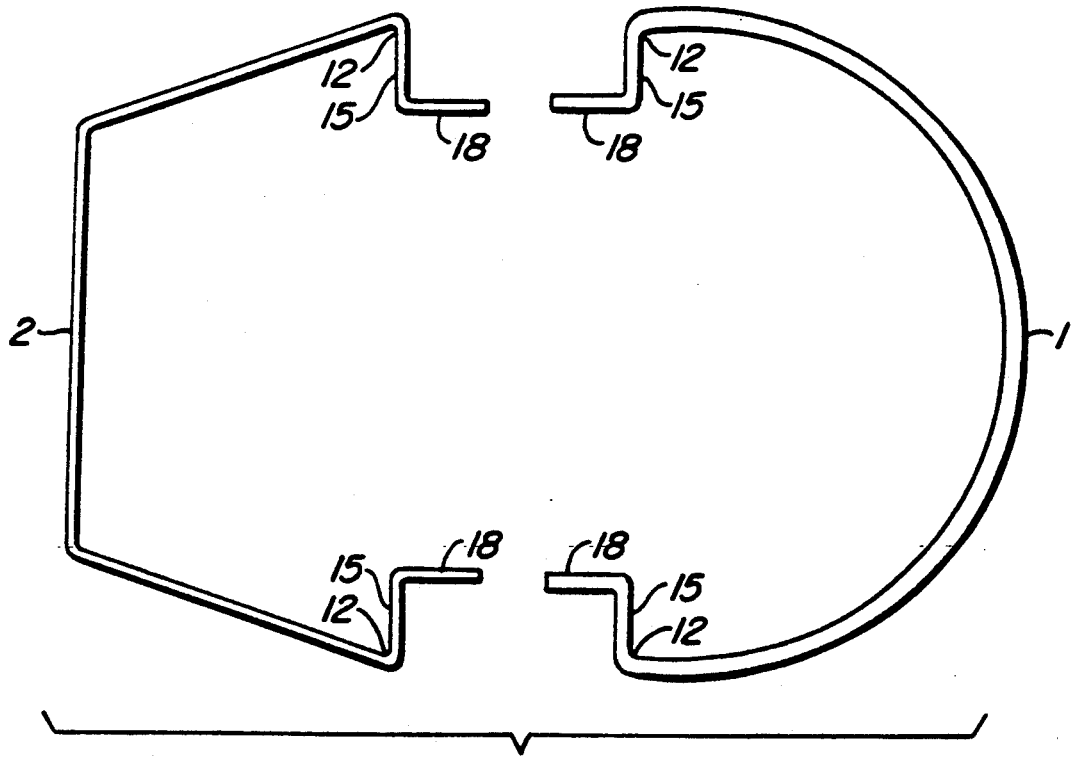

FIG. 1 shows the body of a mast for a racing yacht 12.2 meters long, which employs the principles of the invention. The drawing shows a longitudinal gap 5 in the side walls of the mast which disappears entirely at the top of the mast. The edges 12 of the metal at each side of this gap 5 are reinforced by folding or bending these edges 12 inwards towards the interior of the mast, thus forming stiffening flanges 15 to which the various fittings may be attached by bolts. These stiffening flanges are not restricted by the invention to a simple single bend, as shown on the drawing FIGS. 2–5. Rather, they may incorporate, particularly for large masts (for yachts in the 20 to 30 meter length range), further bends 18 at 90 degrees (see FIG. 7) or corrugations 17 (see FIG. 4) to provide an additional stiffening effect and other flanges (lips) 18 to which fittings may be attached.

We claim:

1. A boat mast comprising:

a fore elongated shell member having a top, a bottom and a length therebetween, and edges and defining a curved cross section with an open trailing side;

an aft elongated shell member having a top, a bottom and a length therebetween, and edges and defining a cross section including at least one flat wall and an open side, the open side of the aft member being disposed generally opposite and facing the open trailing side of the fore member, the edges of the fore and aft members being disposed generally opposite each other and spaced apart;

spacers, disposed at intervals along the length of the mast, joining opposing edges of the aft and fore members while preserving the space separating the opposing edges, the space defined between opposing edges providing access to an interior of the mast; and a fitting for providing an anchorage point for rigging, the fitting being positioned along a neutral axis defined by the interior of the mast so that loads transmitted by the rigging are applied adjacent the neutral axis of the mast.

2. A mast according to claim 1, wherein the fore and aft members are disposed such that the space separating the opposing edges at the bottom of the mast exceeds the space separating the opposing edges at the top of the mast.

3. A mast according to claim 2, wherein the fore and aft elongated shell members each define a constant cross-section, whereby the resultant mast is tapered from bottom to top.

4. A mast according to claim 1, wherein an edge of the fore and aft elongated shell members is re-enterant.

5. A mast according to claim 4, further including a bolt for joining the spacers to the fore and aft elongated shell members.

6. A mast according to claim 1, wherein the fore and aft elongated shell members are extruded metal.

7. A mast according to claim 1, wherein the fore elongated shell member is rolled metal, and wherein the aft elongated shell member is extruded metal.

8. A mast according to claim 1, wherein the fore and aft elongated shell members are aluminum alloy including magnesium as an alloying element.

9. A mast according to claim 1, wherein the fore and aft elongated shell members define asymmetrical cross sections with respect to one another.

10. A mast according to claim 1, wherein a joint line and gap are disposed substantially at 90° with respect to a fore axis and an aft axis of the mast.

11. A yacht mast comprising:

a fore elongated extruded metal shell member being in cross section curved with an open trailing side;

an aft elongated extruded metal shell member having in cross section at least one flat wall and an open side, said open side facing the open trailing side of the fore elongated metal shell member;

spacers joined between and spaced along adjacent edges of the fore and aft elongated metal shell members to form a gap between adjacent edges of the fore and aft elongated shell members, to allow access to the interior of the mast, the fore and aft shells defining a neutral axis; and an internal fitting located in the interior of the mast on the neutral axis for supporting rigging, such that loads applied to the internal fitting by the rigging are applied at or adjacent the neutral axis.

12. A yacht mast according to claim 11, wherein each shell member is of constant cross-section and the adjacent edges of the two longitudinal members are closer at the top of the pole than the bottom to produce a tapered structure.

13. A mast according to claim 12, wherein the edges of each shell member are re-enterant, and the spacers are bolted to the respective shell member.

14. A yacht mast comprising:

a fore elongated roll formed metal shell member being in cross section curved with an open trailing side;

an aft elongated extruded metal shell member having in cross section at least one flat wall and an open side, said open side facing the trailing side of the fore elongated metal shell member;

spacers joined between and spacing along adjacent edges of the fore and aft elongated metal shell members to form a gap between adjacent edges of the fore and aft elongated shell members, to allow access to the interior of the mast, the fore and aft shells defining a neutral axis; and an internal fitting located in the interior of the mast on the neutral axis for supporting rigging, such that loads applied to the internal fitting by the rigging are applied at or adjacent the neutral axis.

15. A yacht mast according to claim 14, wherein the edges of each shell member is re-entrant.

16. A yacht mast according to claim 15, wherei the shell members are an aluminum alloy having magnesium as a major alloying element.

17. A yacht mast according to claim 16, wherein each shell member is of constant cross-section and the adjacent edges of the two longitudinal members are closer at the top of the pole than the bottom, to produce a tapered structure wherein said spacers are welded to the shell members.

* * * * *